US005158172A

United States Patent [19]

Roeser et al.

[11] Patent Number: 5,158,172

[45] Date of Patent: Oct. 27, 1992

[54] TOGGLE SWITCH

[75] Inventors: John O. Roeser; Thomas J. Roeser, both of Barrington, Ill.

[73] Assignee: Otto Engineering, Inc., Carpentersville, Ill.

[21] Appl. No.: 646,873

[22] Filed: Jan. 28, 1991

[51] Int. Cl.[5] ..... H01H 21/00; H01H 3/00

[52] U.S. Cl. ..... 200/553; 200/339

[58] Field of Search ..... 200/559, 339, 302.3, 200/553, 554, 555, 557

[56] References Cited

U.S. PATENT DOCUMENTS

| | | | |
|---|---|---|---|
| 2,027,538 | 1/1936 | Krieger | 200/437 |
| 2,377,134 | 5/1945 | Dietrich | 200/437 |
| 2,726,105 | 12/1955 | Koenig | 200/302.3 |
| 2,795,667 | 6/1957 | Schwerke | 200/437 |
| 3,294,932 | 12/1966 | Barlow | 200/437 |
| 3,299,224 | 1/1967 | De Lorme | 200/6 B |
| 3,350,521 | 10/1967 | Brown | 200/437 |
| 3,571,545 | 3/1971 | Haderer | 200/291 |
| 3,581,003 | 5/1971 | Plumb | 178/170 |
| 3,585,335 | 6/1971 | Bulgarelli | 200/437 |
| 3,591,747 | 7/1971 | Dennison | 200/559 |
| 3,688,062 | 8/1972 | Yamamoto et al. | 200/437 |
| 3,852,557 | 12/1974 | Brown | 200/339 |
| 4,191,387 | 3/1980 | Kirchoff | 200/302.3 |

FOREIGN PATENT DOCUMENTS

| | | | |
|---|---|---|---|
| 1014786 | 3/1950 | France | 200/339 |
| 314162 | 10/1934 | Italy | 200/302.3 |

*Primary Examiner*—Henry J. Recla
*Assistant Examiner*—David J. Walczak
*Attorney, Agent, or Firm*—McAndrews, Held & Malloy, Ltd.

[57] ABSTRACT

A toggle switch includes a toggle lever with a spherical portion that is held against a partially spherical surface by a retaining ring or a pin to permit the toggle lever to swivel. A coil spring coaxial with the toggle lever and enclosing a portion of the lever forces a plunger against an actuator that rocks to place a blade in contact with a terminal to operate the switch. Terminals are molded into the case of the switch to maintain the terminals in a desired position. The actuator may be shaped in one of several ways to provide maintained contact, momentary contact, or a combination of these. Electrical contacts are formed by placing spherical balls or similar shapes made of a contact material into holes in the terminals and then forming the balls or other shapes to produce a contact surface.

16 Claims, 8 Drawing Sheets

Fig. 8
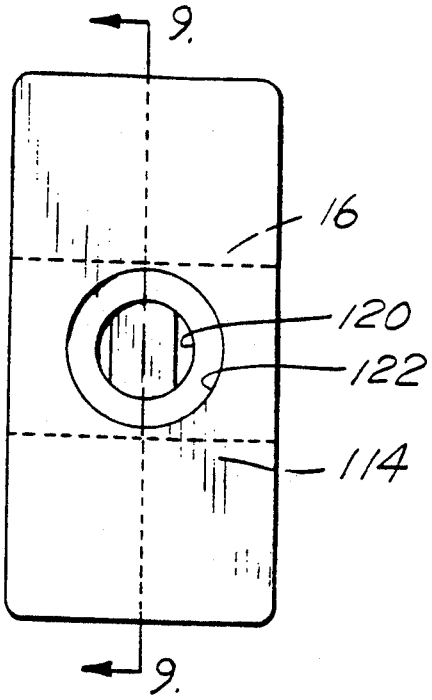
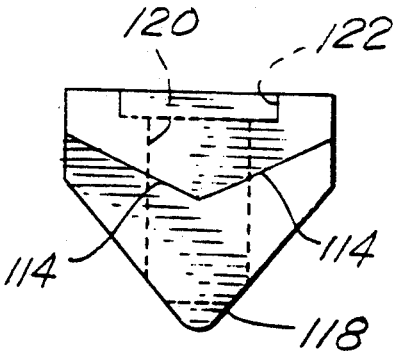
Fig 7
Fig 9
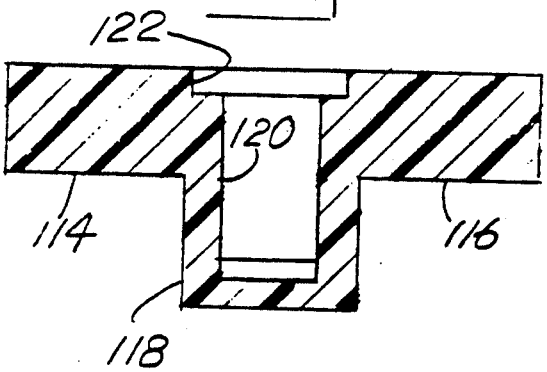

Fig. 11
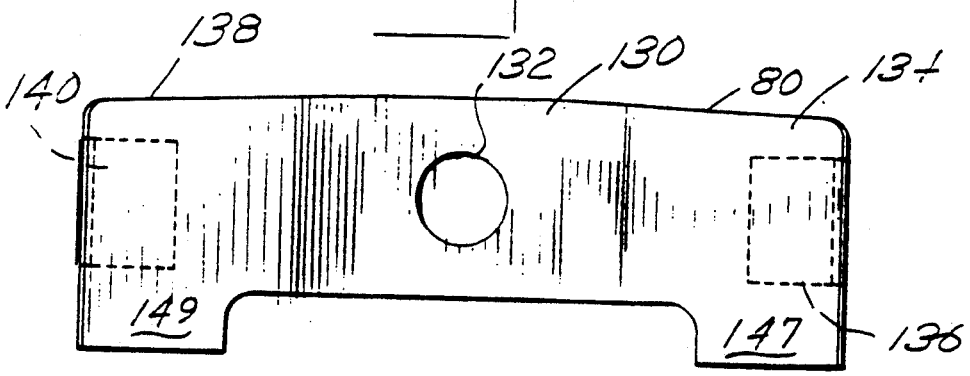
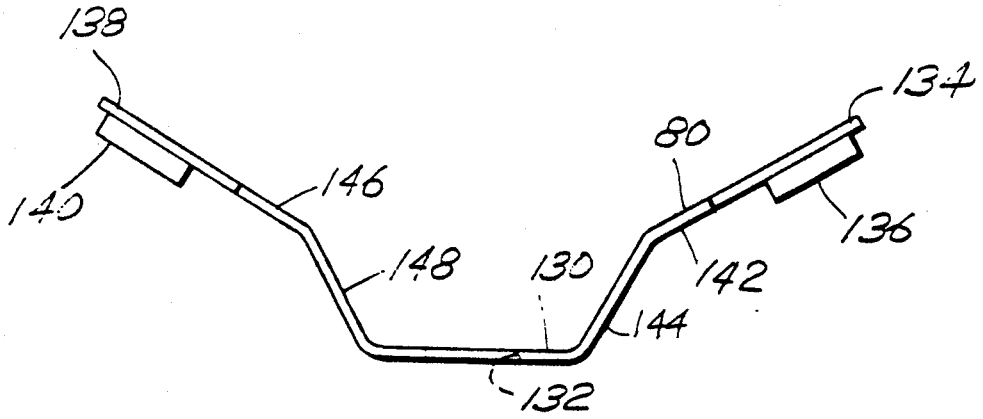
Fig. 10

Fig. 12
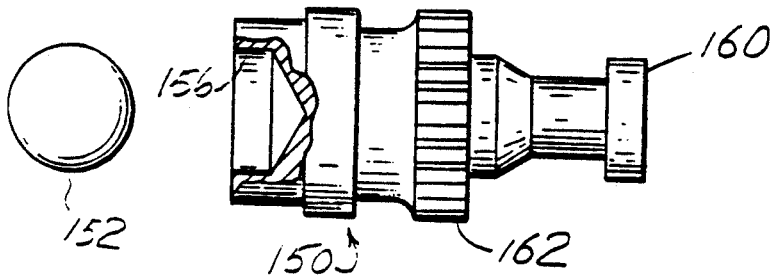
Fig. 13
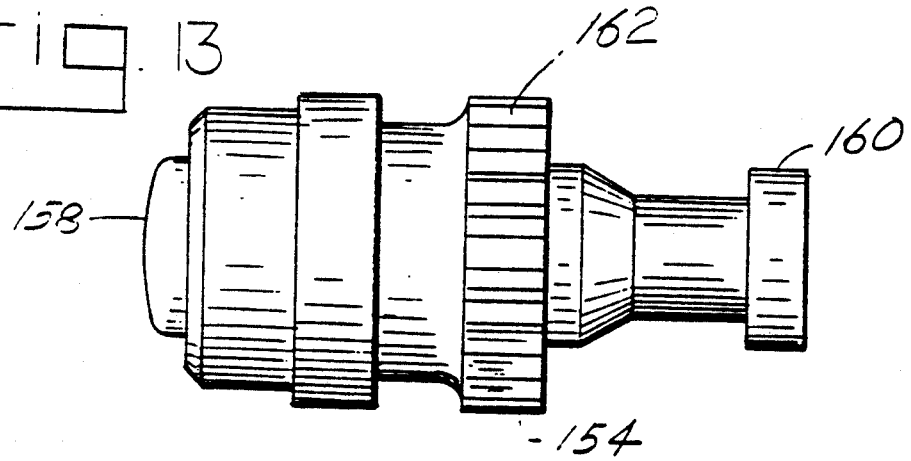
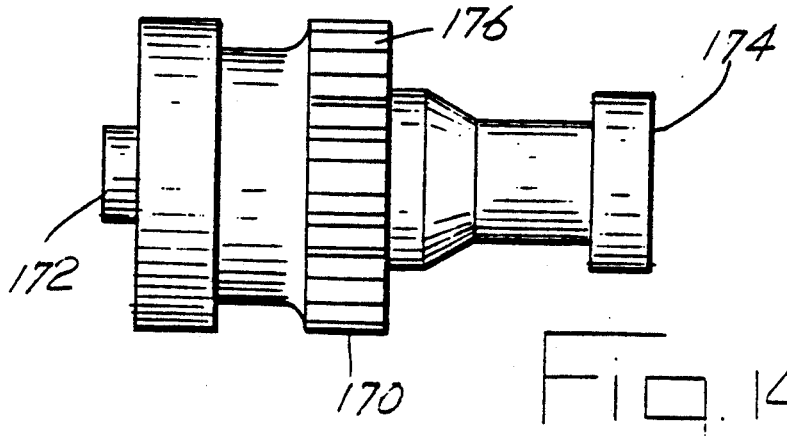
Fig. 14

Fig. 15
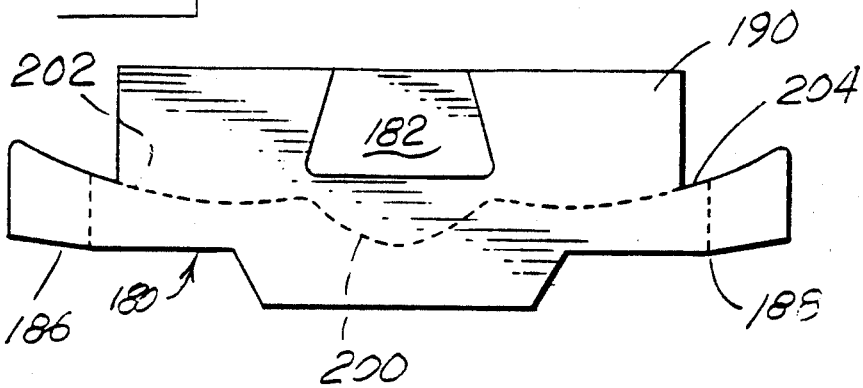
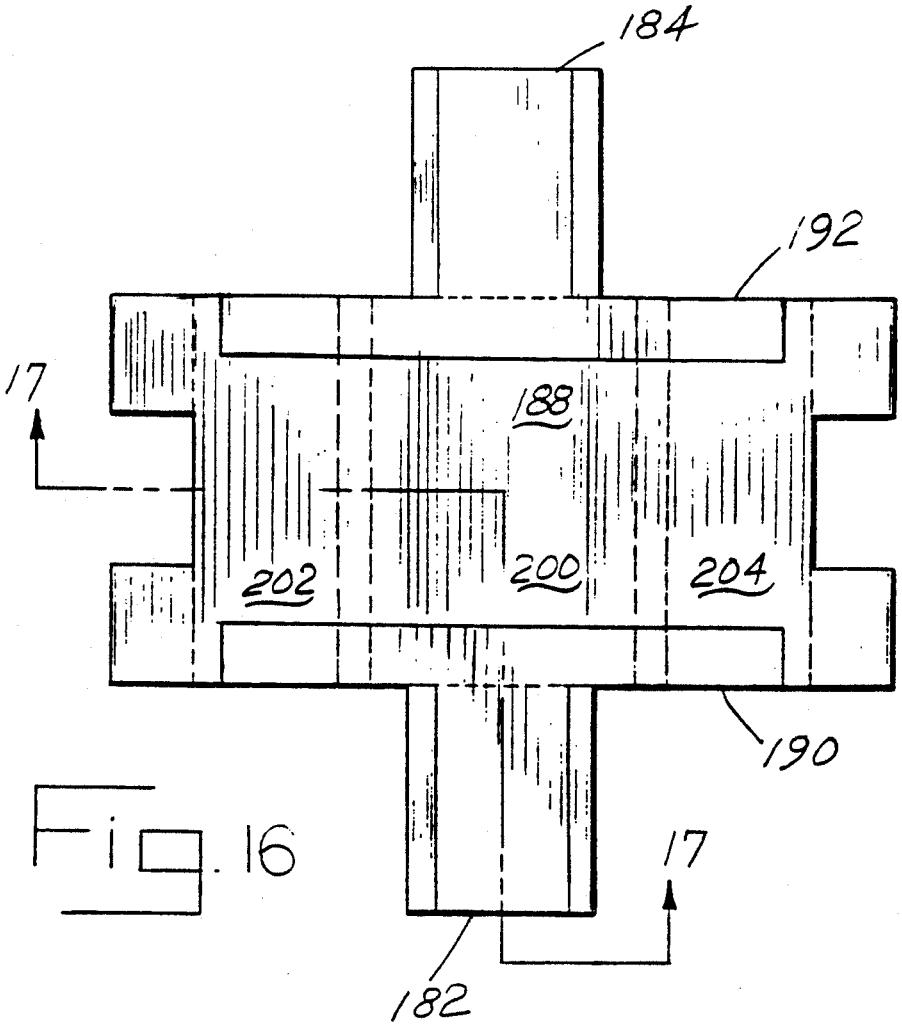
Fig. 16

TOGGLE SWITCH

CROSS-REFERENCES TO RELATED APPLICATIONS

This application is related to our application Ser. No. 07/647,425, entitled "Toggle Switch with Actuator Shaped to Provide All Maintain and Momentary Combinations," filed contemporaneously with this application.

BACKGROUND OF THE INVENTION

This invention is related to electrical toggle switches. In particular, it is an improved toggle switch that is particularly adapted for service as a miniature or subminiature precision toggle switch.

A toggle switch is a device having a plurality of terminals and means operated by a lever for making and breaking electrical connections between pairs of those terminals. A toggle switch typically has two or more stable states, but the term toggle switch is also applied to switches designed for manual operation by means of a toggle lever and having at least one stable state, with other states involving momentary operation. A toggle switch includes a toggle lever that is mounted to a cover or housing so as to pivot about an axis or the like. A spring is typically placed in contact with the toggle lever to exert a biasing force that will maintain the toggle lever in one or more stable positions, in addition to maintaining or assisting in the maintenance of a force on electrical contacts that are being switched into contact. An example of a typical toggle switch that is known in the art is given in U.S. Pat. No. 3,299,224, entitled "Self-Centering Toggle Switch With Improved Actuator Contact Structure," which is incorporated here by reference as though set forth fully. In the '224 patent, a toggle lever is biased by a flat leaf spring which exerts a force tending to restore the toggle lever to a neutral position when the toggle lever is free to move. A switch having such a spring is prone to wear from friction between the spring and the toggle lever. The leaf spring is also best adapted to the application of a force to restore the toggle lever to a neutral position, and is less effective or is ineffective in applying a force to maintain the toggle lever in a position off the neutral position. Switches made according to the teachings of the '224 patent also tend to require more components and to be more difficult to manufacture than the improved toggle switch of the present invention.

A different type of spring for applying a restoring force to a toggle switch is shown in U.S. Pat. No. 3,571,545, entitled "Toggle Switch With Pivotal Shorting Bar Bridging Stationary Contact Pins, And Slidable Cam Block Detent Means." This patent teaches a shorting bar placed on the toggle lever, with a slidable cam biased against a portion of the toggle lever by a coil spring that is coaxial with the toggle lever. The switch of the '545 patent has the disadvantage of making electrical contact with the shorting bar placed on the toggle lever. This requires that at least a handle of the toggle lever be made of an insulating material so that there is no danger of electric shock to a user of the switch.

U.S. Pat. No. 3,581,003, entitled "Toggle Switch," which is incorporated here by reference as though set forth fully, teaches a toggle switch in which a restoring force for the toggle lever is supplied by a coil spring that is fitted in a hole in the toggle lever that is coaxial with the lever. This results in a coil spring of a relatively small diameter. The smaller coil spring of the '003 patent is more easily broken than a coil spring such as the one disclosed and claimed in the present invention that is large enough in diameter to enclose the toggle lever. For this reason, a toggle switch made according to the teaching of the '003 patent typically has a shorter service life than a toggle switch made according to the teachings of the present invention. The larger spring may also exert a greater force for toggle activation.

It is an object of the present invention to provide a better electrical toggle switch.

It is a further object of the present invention to provide a more reliable miniature or subminiature electrical toggle switch.

It is a further object of the present invention to provide a miniature or subminiature electrical toggle switch that is easier to manufacture than toggle switches that are presently known.

It is a further object of the present invention to provide a miniature or subminiature electrical toggle switch that can be manufactured so as to function in one of a plurality of maintain or momentary combinations by changing a single part during manufacture.

It is a further object of the present invention to provide a miniature or subminiature electrical toggle switch in which a toggle lever pivots in its housing on a spherical portion of the toggle lever.

It is a further object of the present invention to provide a terminal for a miniature or subminiature electrical toggle switch that has an electrical contact surface formed by placing a spherical ball of a material that is appropriate for electrical contacts in a cylindrical aperture in the terminal and then heading the spherical ball nearly flat while peening it into place.

It is a further object of the present invention to provide a miniature or subminiature electrical toggle switch in which forces tending to restore the switch to a maintained position from a momentary position and also to apply contact pressure are obtained from a single coil spring that encloses a toggle lever.

Other objects will become apparent in the course of a detailed description of the invention.

SUMMARY OF THE INVENTION

A toggle switch includes a toggle lever with a spherical portion that is held against a partially spherical surface in a cover by a retaining ring to permit the toggle lever to swivel. A coil spring coaxial with the toggle lever and enclosing a portion of the lever forces a plunger against an actuator that rocks to place a blade in contact with a terminal to operate the switch. The plunger is constrained to planar motion by either the case or the actuator, which causes the toggle lever to move substantially in a plane. Terminals are molded, pressed, or staked into the case of the switch to maintain the terminals in a desired position. The actuator may be shaped in one of several ways to provide the operation of maintained contact, momentary contact, or a combination of these, and only the actuator need be changed to change the type of operation. Electrical contacts are formed by heading spherical balls into holes in the terminals and then flattening the balls to produce a contact surface.

BRIEF DESCRIPTION OF THE DRAWINGS

FIG. 7 is an end view of the plunger of FIG. 2.

FIG. 8 is a top view of the plunger of FIG. 2.

FIG. 9 is a sectional side view of the plunger of FIG. 2.

FIG. 10 is a side view of a blade.

FIG. 11 is a top view of the blade.

FIG. 12 is a partial sectional central view of a terminal and a ball.

FIG. 13 is a side view of a terminal assembly.

FIG. 14 is a side view of a center terminal.

FIG. 15 is a side view of an actuator for a maintain-maintain-maintain toggle switch.

FIG. 16 is a top view of the actuator of FIG. 15.

DETAILED DESCRIPTION OF THE INVENTION

Figure 1:
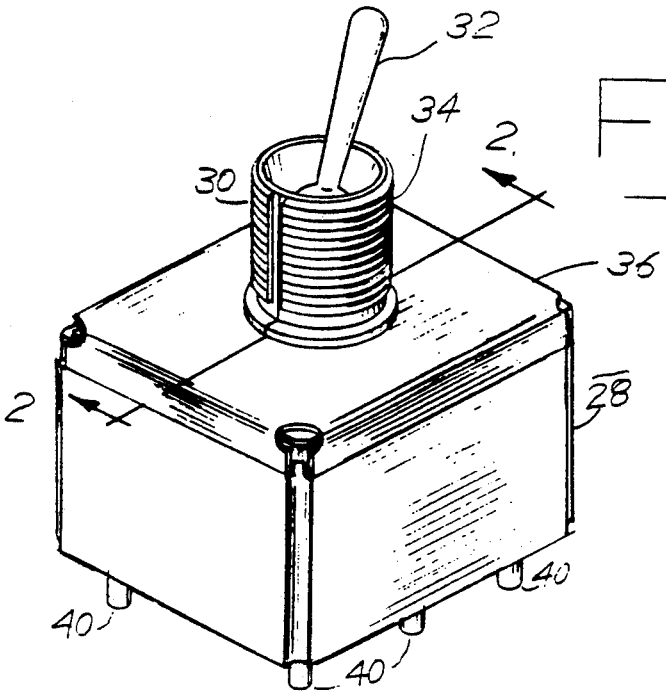
FIG. 1 is a perspective view of a toggle switch for the practice of the present invention.

FIG. 1 is a perspective view of a toggle switch 28 for the practice of the present invention. In FIG. 1, a toggle lever assembly 30 includes a toggle lever 32 that projects from a bushing 34 that is secured to a cover 36. The cover 36 is connected to a case 38. A number of terminals 40 project from the case 38 to make external electrical connections that are to be switched by the toggle switch 28.

Figure 2:
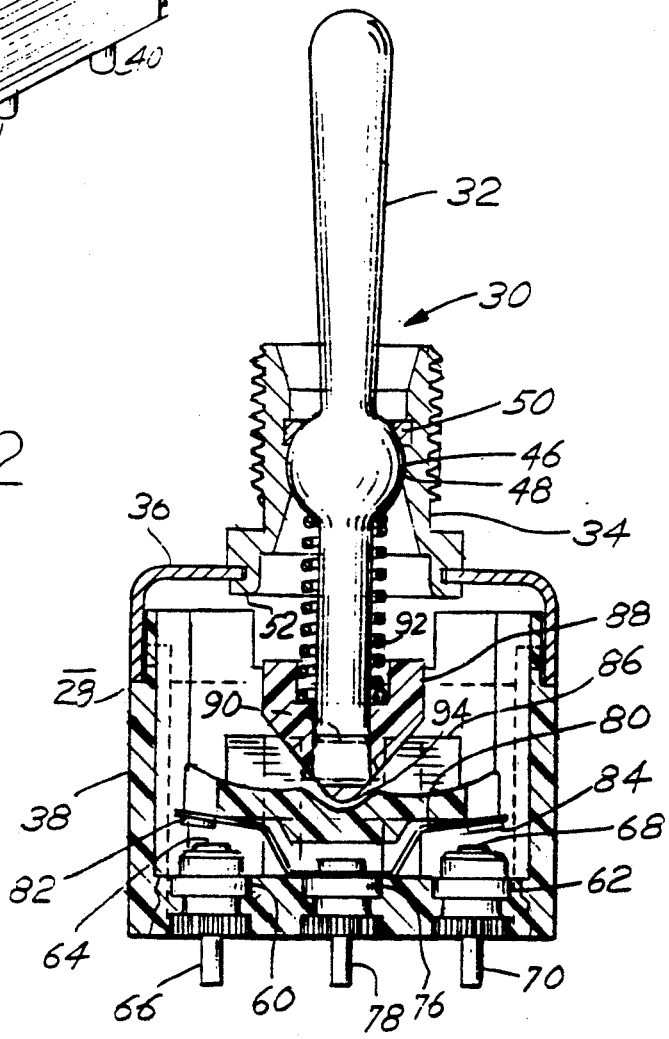
FIG. 2 is a sectional side view of the switch of FIG. 1, taken along section lines 2—2 of FIG. 1.

FIG. 2 is a sectional side view of the toggle switch 28, taken along section lines 2—2 of FIG. 1. In FIG. 2, the toggle lever 32 is inserted in the bushing 34. A spherical section 46 of the toggle lever 32 rests on a spherical surface 48 of the bushing 34 and is held in place by a retaining ring 50 so that the toggle lever 32 pivots by sliding against the surface 48 and the retaining ring 50, which thus functions also as a bearing. The toggle lever 32, the bushing 34, the retaining ring 50, and the cover 36 when assembled comprise the toggle lever assembly 30. In the alternative, the spherical section 46 could be pinned to the bushing 34 to support the toggle lever 32 and also provide support to rotate the toggle lever 32. The toggle lever assembly is most readily assembled by connecting the bushing 34 to the cover 36. The toggle lever 32 is then inserted into the bushing 34, and the retaining ring 50 (or a pin, if one is used) is placed to complete the assembly.

The toggle lever assembly 30 is inserted into the case 38, where it is held in place by crimping the corners of the cover 36 to the case 38. A headed portion 52 may be rolled, glued, welded, swaged or otherwise shaped to secure the bushing 34 to the cover 36, which in turn is secured to the case 38 as described above.

A terminal 60 is molded or otherwise inserted into the case 38 on one side and a terminal 62 is inserted correspondingly on the other side. The terminal 60 may include a shaped contact ball 64 that is inside the case 38 and a terminal pin 66 that is outside. Similarly, the terminal 62 includes a shaped contact ball 68 that is inside the case 38 and a terminal pin 70 that is outside.

A terminal 76, which is located between the terminals 60 and 62, has a terminal pin 78 that is outside the case 38. The terminal 76 is molded or otherwise inserted into the case 38 and is riveted, swaged, staked or the like to connect it to a blade 80. The blade 80 has a contact 82 that is placed opposite the shaped contact ball 64 and a contact 84 that is placed opposite the shaped contact ball 68. The switch of the present invention establishes electrical contact between the terminal pins 66 and 78 by pressing the blade 80 to place the contact 82 against the shaped contact ball 64. Similarly, the electrical contact between the terminal pins 70 and 78 is established by pressing the blade 80 to place the contact 84 against the shaped contact ball 68. Each of these switching operations is effected by rocking an actuator 86 in response to a force exerted by a plunger 88, which in turn is operated by an end 90 of the toggle lever 32. The spring action of the blade 80 provides a restoring force to open the switch by separating the contact 82 from the shaped contact ball 64 and the contact 84 from the shaped contact ball 68. It will be seen that the shape of the actuator 86 determines whether or not the action of the switch will be such as to maintain a selected position or to return from that position.

A coil spring 92 is coaxial with and encloses the toggle lever 32 and is compressed by the spherical section 46 of the toggle lever 32 to force a tip 94 of the plunger 88 against the actuator 86. The fact that the coil spring 92 surrounds the toggle lever 32 allows the coil spring 92 to be larger in coiled diameter and thus sturdier than it would be if it were sized for insertion into the toggle lever 32. This both makes it easier to manufacture the switch and also makes a longer-lasting switch.

Figure 3:
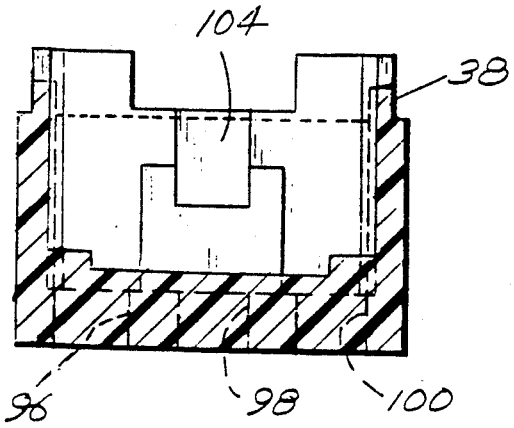
FIG. 3 is a sectional side view of the switch case of FIG. 2, taken along section lines 3—3 of FIG. 2.
Figure 4:
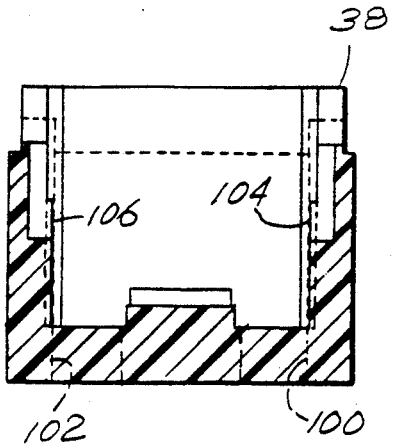
FIG. 4 is a sectional end view of the switch case of FIG. 2, taken along section lines 4—4 of FIG. 2.

FIG. 3 is a partial sectional side view of the case 38 of FIGS. 1 and 2, taken along section lines 3—3 of FIG. 2, and FIG. 4 is a sectional end view of the case 38, taken along section lines 4—4 of FIG. 2. In FIGS. 3 and 4, a plurality of holes 96, 98, 100, and 102 provide for the insertion of appropriate ones of the terminals 40, 60, and 76 of FIGS. 1 and 2. In the preferred embodiment, the terminals 40, 60, and 76 are molded into the case 38. They could also be pressed in so as to make an interference fit. Other ways of securing the terminals in place could also be used. A slot 104 supports one side of the actuator 86 and a slot 106 supports the other side, permitting the actuator 86 of FIG. 2 to rock and thereby add torsion to the spring to press or release the blade 80 so as to make or break contact in case the contacts weld. Clearance of the actuator 86 with the slots 104 and 106 limits motion of the toggle lever 32 essentially to a plane with a minimum of side-to-side wobble.

Figure 5:
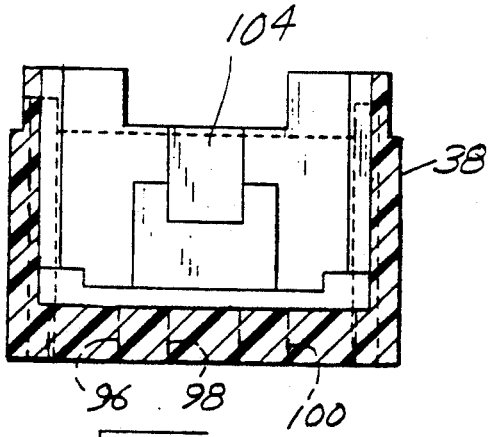
FIG. 5 is a sectional side view of a switch case for a single set of terminals, taken along section lines 5—5 of FIG. 2.
Figure 6:
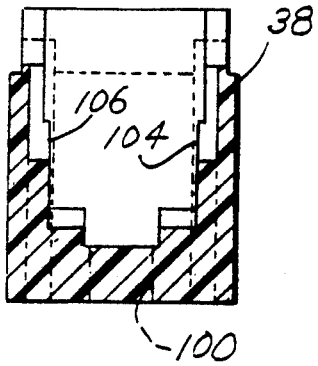
FIG. 6 is a sectional end view of the switch case of FIG. 5, taken along section lines 6—6 of FIG. 2.

FIGS. 3 and 4 show an embodiment of the invention that is a case for a double pole-double throw switch that switches two sets of terminals. An alternate embodiment is shown in FIGS. 5 and 6 which are respectively a sectional side view of the case 38 of FIG. 1 and a sectional end view of the case 38 for a toggle switch 28 having one set of terminals. In FIGS. 5 and 6 the holes 96, 98 and 100 correspond to those of FIGS. 3 and 4, but there is only one set of holes, represented in FIG. 6 by the hole 100 which shows a line of terminals that are molded into the case 38. The slots 104 and 106 correspond to the identically numbered slots in FIGS. 3 and 4. The case 38 of FIGS. 5 and 6 is narrower than that of FIGS. 3 and 4 and is useful when a single pole-double throw switch is desired. It should also be evident that these two embodiments could be used as either a single pole-single throw or a double pole-single throw switch by omitting or not connecting one or two of the outside terminals.

FIG. 7 is an end view of the plunger 88 of FIG. 2, FIG. 8 is a top view of the plunger 88 and FIG. 9 is a sectional side view of the plunger 88, taken along section lines 9—9 of FIG. 8. In FIGS. 7, 8 and 9, a first beveled shoulder 114 and a second beveled shoulder 116 are relieved from a tip 118 that projects into and contacts the actuator 86 of FIG. 2. The shoulders 114 and 116 are beveled to avoid interfering with motion of the actuator 86 when it rocks. A hole 120 receives an end of the toggle lever 32 of FIG. 1 and a collar 122 that is coaxial with the hole 120 receives the coil spring 92 of FIG. 3 to provide toggle action and maintain an axial force on the plunger 88.

FIG. 10 is a side view of the blade 80 of FIG. 2 and FIG. 11 is a top view of the blade 80. When the blade 80 is used with the double pole-double throw switch of FIGS. 3 and 4, two blades 80 are used, one reversed in position with respect to the other. A single blade 80 is used with the single pole-double throw switch of FIGS. 5 and 6. In FIGS. 10 and 11, the blade 80 includes a mounting flat 130 that includes a substantially centered hole 132. A first spring arm 134 supports a first contact 136 and a second spring arm 138 supports a second contact 140. The blade 80 is staked, riveted, or similarly secured through the hole 132 to the terminal 76 of FIG. 2. An outer portion 142 of the first spring arm 134 is bent at an angle of about thirty degrees to an inner portion 144, and an outer portion 146 of the arm 138 is similarly bent at an angle of about thirty degrees to an inner portion 148. These portions of the arms 134 and 138 cause the contacts 13 and 140 to wipe the contacts 64 and 68 of FIG. 2, thus making good electrical connections and also tending to break any contact welds that may occur, since the wiping tendency occurs both on make and on break in response to motion of the actuator 86. In addition, a tab 147 and a tab 149 extend from the blade 80 so as both to allow overtravel of the actuator 86 by letting the blade 80 twist, reducing required tolerances in manufacture, and also to provide an off-center torsional force that tends to make better wiping contact and to break contact welds. These effects are of particular utility in making a double pole-double throw toggle switch.

FIG. 12 is a partial central sectional view of a terminal 150 and a ball 152, and FIG. 13 is a side view of a terminal assembly 154 that is produced by inserting the ball 152 into a substantially cylindrical orifice 156 and peening, pressing or otherwise deforming the terminal 150 and ball 152 into a contact 158 in which the ball 152 has been substantially flattened. A spherical ball 152 has been used in the practice of the invention but it should be evident that other shapes as convenient could be used. The terminal 150 has a turret connection 160 which is one of many well-known types of external connectors. The particular external connector that is used is a matter of design choice. The terminal assembly 154 has a knurled region 162 that provides extra gripping force to prevent rotation when the terminal assembly 154 is molded or pressed into one of the holes 96 or 100 of FIG. 3. The terminal assembly 154 is thus typically held in place by an interference fit.

FIG. 14 is a side view of a center terminal 170 that includes a head 172 that is peened, swaged, or staked over the hole 98 of FIG. 3 to secure the blade 80 of FIGS. 10 and 11 at the holes 132. The center terminal 170 has a turret connection 174, again a matter of design choice; other types of connections could be used. The center terminal 170 is itself secured to, and secures the blade 80 to, the case 38 by a knurled region 176 that is molded into the hole 98 of FIG. 3.

Figure 17:
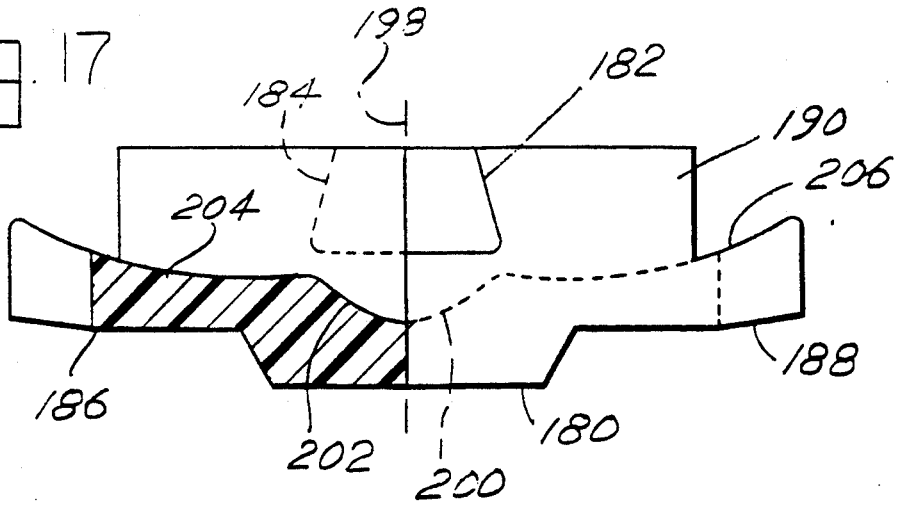
FIG. 17 is a split sectional side view of the actuator of FIG. 15, taken along sectional lines 17—17 of FIG. 15.

FIG. 15 is a side view of an actuator 180 for the practice of the present invention, FIG. 16 is a top view of the actuator 180, and FIG. 17 is a split sectional side view of the actuator 180, taken along section lines 16—16 of FIG. 15. In FIGS. 15, 16 and 17, a first rocker arm 182 and a second rocker arm 184 engage the slots 104 and 106 respectively of FIGS. 3–6 to support the actuator 180 against a force applied by the coil spring 92 to the plunger 88. The actuator 180 has a first contact surface 186 that is pressed by the tip 94 of the plunger 88 into engagement with the first spring arm 134 of the blade 80 and a second contact surface 188 that is similarly pressed into engagement with the second spring arm 138 of the blade 80. The arms 182 and 184 are shaped to provide a relief that permits the rocker arms 182 and 184 to pivot in the slots 104 and 106 without interference. A first wall 190 and a second wall 192 in the actuator 180 both align the actuator 180 in the case 38 and also guide motion of the plunger 90 in the actuator 180.

The actuator 180 is one of a family of similar actuators that are shaped differently to function differently. The actuator 180 is designed for a maintain-maintain-maintain toggle switch. This means that it has three stable positions, with the toggle lever 32 stable respectively at the left, center and right in FIG. 2. Referring to FIGS. 14–16, these stable positions are obtained as follows. The first stable position is determined by a first surface 200 and a second surface 202 of the actuator 180, each of which is substantially an arc of a circle that is centered on an opposite side of a centerline 198 from each of the surfaces 200 and 202. The surfaces 200 and 202 receive and contain the tip 94 of the plunger 90 when the toggle lever 32 is in the center position in FIG. 2. A third surface 204 is shaped to receive and maintain the tip 94 of the plunger 90 in a second stable position when the toggle lever 32 is moved to the right in FIG. 2. A fourth surface 206 is shaped to receive and maintain the tip 94 of the plunger 90 in a stable position when the toggle lever 32 is moved to the left in FIG. 2. When the toggle lever 32 is either to the left or to the right in FIG. 2, one of the contacts 136 or 140 is moved to touch its associated terminal 60 or 62. The action of the switch is thus one of maintain a closed circuit in one direction, maintain a closed circuit in the other direction, or maintain two open circuits in a central position. The third surface 204 is substantially a portion of a cylinder having a center located on the same side of the centerline 198 as the surface 204, and the fourth surface 206 is substantially a portion of a cylinder centered on the same side of the centerline 198 as the surface 206.

A characteristic of the actuator 86 that is shared by all of its versions that are disclosed here is the fact that the path traveled by the end 90 of the plunger 92 on the actuator 86 is closer to the blade 80 than the pivot provided by the rocker arm 266. This tends to cause a frictional couple that keeps the actuator 86 in whatever position it is in until the end 90 of the plunger 92 passes the pivot. This structural feature provides for positive and secure positioning of the toggle lever 32 in any position that it maintains. The pivot point will be seen to vary in different versions of the actuator 82.

Figure 18:
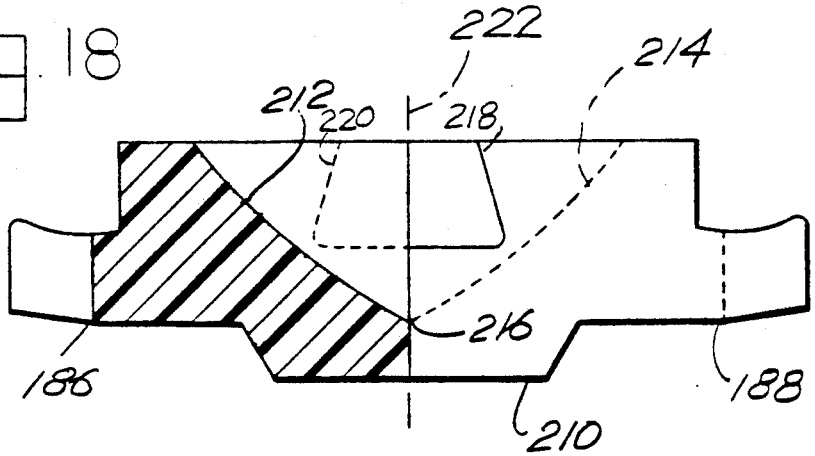
FIG. 18 is a split sectional side view of an actuator for a momentary-maintain-momentary toggle switch.

FIG. 18 is a split sectional view of an actuator 210 that corresponds to the actuator 180 of FIGS. 15, 16 and 17. The actuator 210 is different in that it is designed for use in a momentary-maintain-momentary toggle switch. That is to say, the actuator 210 has a stable position with the toggle lever 32 in the center position and must be held in place manually at either the left or the right in FIG. 2 to make continued contact. To function this way, the actuator 210 includes a first contact surface 186 and a second contact surface 188 like those of the actuator 180 of FIG. 17. In FIG. 18, a first surface 212 meets a second surface 214 to form a groove 216. Both a first rocker arm 218 and a second rocker arm 220 have trapezoidal cross-sections like the rocker arms 182 and 184 of FIG. 16, and they support the actuator 210 similarly in the slots 104 and 106 of the case 38 of FIGS. 3–6. The pivot points of the actuator 210 are the angles of the trapezoidal cross-sections, so that the actuator 210 pivots on one angle in one direction and the other angle in the other direction. It should be evident that the trapezoidal shape is only one of many ways to provide relief for the actuator 210 to pivot without interference from the housing. The first surface 212 is a portion of a cylinder centered on a side of a centerline 222 that is opposite to the side of the first surface 212, and the second surface 214 is similarly a portion of a cylinder that is centered on a side of the centerline 222 opposite to that of the second surface 214. The surfaces 212 and 214 thus exert restoring forces on the plunger 88 to accomplish the momentary-momentary positioning on either side of the central position of the switch and to maintain the central position by tending to return the toggle lever 32 to the central position.

Figure 19:
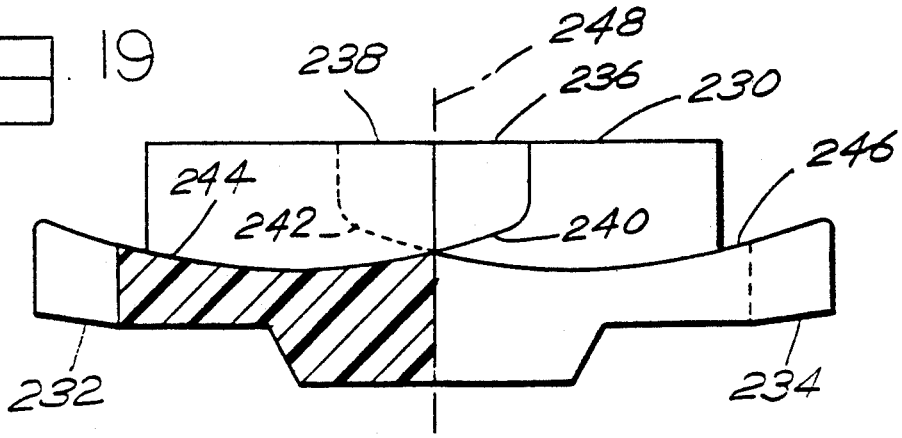
FIG. 19 is a split sectional side view of an actuator for a maintain-maintain toggle switch.

FIG. 19 is a split sectional side view of an actuator 230 for a maintain-maintain toggle switch. In FIG. 19, a first contact surface 232 and a second contact surface 234 can be rocked into contact with the blade 80 of FIG. 10. A first rocker arm 236 and a second rocker arm 238 project to support the actuator 230 in the slots 104 and 106 of FIG. 6. The rocker arms 236 and 238 include beveled surfaces 240 and 242 which bias the actuator away from a neutral position and into a position at one side or the other. The tip 118 of FIG. 7 contacts the actuator 230 either on a surface 244 or on a surface 246. The surfaces 244 and 246 are substantially cylindrical with the center of each cylinder on the same side of a centerline 248 as its corresponding surface. The tip 118 will thus have stable positions at the left and the right but not in the center.

Figure 20:
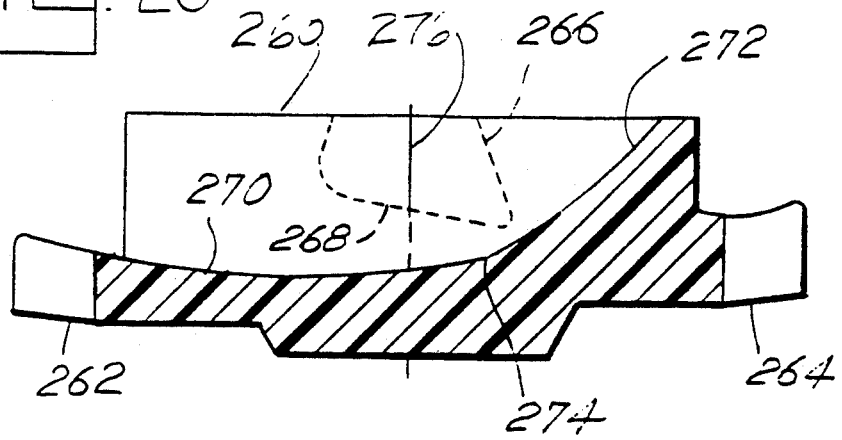
FIG. 20 is a sectional side view of an actuator for a maintain-momentary toggle switch.

FIG. 20 is a sectional side view of an actuator 260 for a maintain-momentary toggle switch. In FIG. 20, a first contact surface 262 and a second contact surface 264 can be rocked into contact with the blade 80 of FIG. 10 to operate the toggle switch. A rocker arm 266 has a single beveled surface 268 that is canted to bias the actuator 266 to keep the first contact surface 262 in contact with the blade 80. A first cylindrical surface 270 intersects a second cylindrical surface 272 at a line 274 that is on the same side of a centerline 276 as the surface 272. The cylinders forming both of the surfaces 270 and 272 are centered on the same side of the centerline 276 as the surface 270. This causes the tip 188 to have a stable position on the surface 270 and an unstable position on the surface 272, resulting in a maintained contact on the side of the surface 270 and a momentary contact on the side of the surface 272 that persists only while the toggle lever 32 is held manually in this position.

Figure 21:
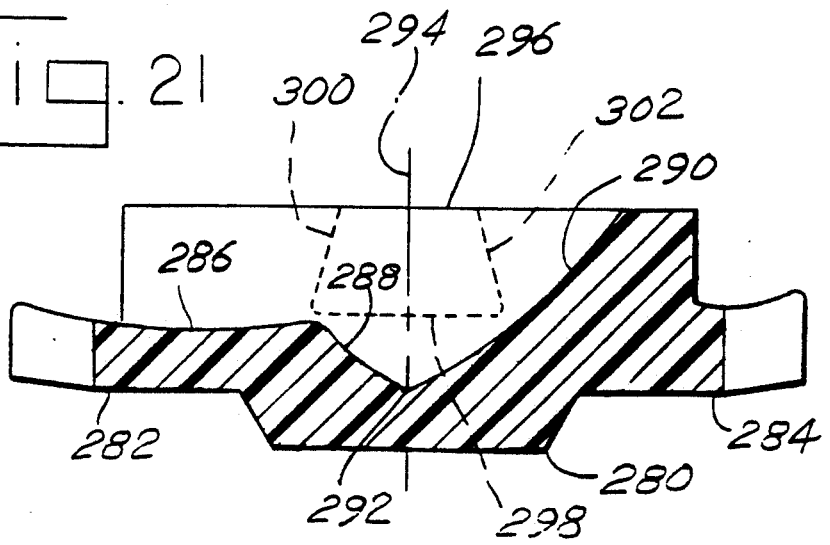
FIG. 21 is a sectional side view of an actuator for a maintain-maintain-momentary toggle switch.

FIG. 21 is a sectional side view of an actuator 280 for use with a maintain-maintain-momentary toggle switch. In FIG. 21, a first contact surface 282 and a second contact surface 284 rock into contact with the blade 80 to operate the switch. A first cylindrical surface 286 is faired into contact with a second cylindrical surface 288 which is connected to a third cylindrical surface 290 at a line 292 that intersects a centerline 294. The cylindrical surfaces 286 and 290 are centered on the same side of the centerline 294 as the surface 286, while the surface 288 is centered on the side of the surface 290. When the tip 118 of the plunger 88 of FIG. 7 is in contact with both the surfaces 286 and 290, it is maintained in a central or neutral position. When the tip 118 is in contact with the surface 286, it is maintained in an on position and when it is in contact with the surface 290, it is biased toward the neutral position and must be held to maintain contact. A rocker arm 296 has a flat surface 298 and a pair of sides 300 and 302 that are beveled to facilitate rotation of the rocker arm 296 in the slots 104 and 106 of FIG. 6. The actuator 290 thus rocks about the edges 304 and 306 where the flat surface 298 meets the beveled sides 300 and 302.

In a toggle switch that has been built and tested for the practice of the present invention, the toggle lever 32 was made of stainless steel, the cover 36 was aluminum and the bushing 34 was stainless steel. The contact balls 64 were made of fine silver, and were nominally 0.062 inches in diameter before they were flattened as described above. Using these contacts, the switches were designed to interrupt currents of up to five amperes in resistive loads and three amperes in loads having substantial inductive components. The switch that was tested performed satisfactorily at voltages up to 120 volts ac and 28 volts dc. The blades 80 were made of beryllium copper that was plated first with silver and then with gold. The contacts 82 and 84 of the blades 80 were of a silver-copper laminate. The case 38 was made of diallyl phthalate, an insulating plastic material, and the coil spring 92 was stainless steel. The materials thus described are those used in the best mode known for the practice of the invention, but are clearly not the only materials that could be used.

The description of the invention given here and of the method of practicing it is intended to illustrate the best mode known to the inventors. It should be taken as illustrative and not as limiting, and the scope of protection for the invention should be limited only by the appended claims and their equivalents.

We claim:

1. An electrical toggle switch comprising:

(a) a case;

(b) a toggle lever having a cylindrical end and a substantially centrally located spherical portion;

(c) a cover attached to the case, the cover having an inner spherical surface disposed to engage the spherical portion of the toggle lever;

(d) a retaining ring disposed to maintain the toggle lever in contact with the spherical portion of the cover, the retaining ring being securely inserted in place on the cover, the retaining ring functioning also as a bearing on the spherical portion of the toggle lever;

(e) a blade having blade contact;

(f) an external thermal connected to the blade and the case to secure the blade to the case and provide an external electrical connection to the blade;

(g) a fixed electrical contact connected to the case and disposed to make and break an electrical connection with the blade contact;

(h) an actuator mounted so as to rock in the case, the actuator moving the blade to make and break the electrical connection between the blade contact and the fixed contact;

(i) a plunger mounted to slide on the cylindrical end of the toggle lever and move the actuator; and (j) a coil spring sized to enclose the cylindrical end of the toggle lever and engage the plunger so as to apply an axial force between the toggle lever and the plunger.

2. The toggle switch of claim 1 wherein the case is shaped to constrain motion of the plunger and hence of the toggle lever substantially in a plane.

3. The toggle switch of claim 1 wherein the actuator is mounted so as to rock in the case about a pivot that is further from the blade than a path of the plunger, thereby producing a frictional couple that tends to keep the actuator in a position until the plunger is moved past the pivot.

4. The toggle switch of claim 1 wherein the actuator is shaped to provide a maintain-maintain-maintain toggle switch.

5. The toggle switch of claim 1 wherein the actuator is shaped to provide a momentary-maintain-momentary toggle switch.

6. The toggle switch of claim 1 wherein the actuator is shaped to provide a maintain-maintain toggle switch.

7. The toggle switch of claim 1 wherein the actuator is shaped to provide a maintain-momentary toggle switch.

8. The toggle switch of claim 1 wherein the actuator is shaped to provide a maintain-maintain-momentary switch.

9. An electrical toggle switch comprising:

(a) a case having material removed to define a pair of internal slots;

(b) a toggle lever having a cylindrical end and a substantially centrally located spherical portion;

(c) a cover attached to the case, the cover having an inner spherical surface disposed to engage the spherical portion of the toggle lever;

(d) a retaining ring disposed to maintain the toggle lever in contact with the spherical portion of the cover, the retaining ring being securely inserted in place in the cover so as to support the toggle lever to pivot with respect to the case, the retaining ring functioning also as a bearing on the spherical portion of the toggle lever;

(e) a blade having a blade contact;

(f) an external contact connected to the blade and the case to secure the blade to the case and provide an external electrical connection to the blade;

(g) a fixed electrical contact connected to the case and disposed to make and break an electrical connection with the blade contact;

(h) an actuator mounted so as to rock in the pair of internal slots in the case, the actuator moving the blade to make and break the electrical connection between the blade contact and fixed contact;

(i) a plunger mounted to slide on the cylindrical end of the toggle lever and move the actuator; and (j) a coil spring sized to enclose the cylindrical end of the toggle lever and engage the plunger so as to apply an axial force between the toggle lever and the plunger.

10. The toggle switch of claim 9 wherein the case is shaped to constrain motion of the plunger and hence of the toggle lever substantially in a plane.

11. The toggle switch of claim 9 wherein the actuator is shaped to constrain motion of the plunger and hence of the toggle lever substantially in a plane.

12. The toggle switch of claim 9 wherein the actuator is shaped to provide a maintain-maintain-maintain toggle switch.

13. The toggle switch of claim 9 wherein the actuator is shaped to provide a momentary-maintain-momentary toggle switch.

14. The toggle switch of claim 9 wherein the actuator is shaped to provide a maintain-maintain toggle switch.

15. The apparatus of claim 9 wherein the actuator is shaped to provide a maintain-momentary toggle switch.

16. The toggle switch of claim 9 wherein the actuator is shaped to provide a maintain-maintain-momentary switch.

* * * * *